United States Patent [19]

Bresnen

[11] Patent Number: 4,892,251

[45] Date of Patent: Jan. 9, 1990

[54] LINE MARKING DEVICE

[76] Inventor: Harrison Bresnen, 571 Elbridge Rd., Morrisville, Pa. 19067

[21] Appl. No.: 270,662

[22] Filed: Nov. 14, 1988

[51] Int. Cl.[4] ..... E01C 23/16; B05B 15/06

[52] U.S. Cl. ..... 239/150; 239/176; 239/280; 239/754

[58] Field of Search ..... 239/150, 159, 164, 165, 239/176, 280, 280.5, 281, 288–288.5, 526, 532, 722, 754

[56] References Cited

U.S. PATENT DOCUMENTS

| | | | |
|---|---|---|---|
| 3,236,455 | 2/1966 | Lewis et al. | 239/280 |
| 3,508,709 | 4/1970 | Small et al. | 239/754 |
| 3,700,174 | 10/1972 | Beck | 239/532 |
| 4,624,602 | 11/1986 | Kieffer et al. | 239/150 |

FOREIGN PATENT DOCUMENTS

| | | | |
|---|---|---|---|
| 2041785 | 9/1980 | United Kingdom | 239/176 |

*Primary Examiner*—Robert J. Oberleitner
*Assistant Examiner*—Karen B. Merritt
*Attorney, Agent, or Firm*—William L. Muckelroy & Associates

[57] ABSTRACT

A line marking device for installation of parking lines and traffic markings comprising an airless paint spray mechanism adjustably attachable to a wheeled, support carrier to permit delivery of a trapezoidal paint spray to the surface of the road or pavement to mark stripes of varying widths.

3 Claims, 4 Drawing Sheets

LINE MARKING DEVICE

BACKGROUND OF THE INVENTION

This invention generally relates to surface marking devices adapted to mark a guide line or stripe upon the surface of a road or pavement. More specifically, the present invention relates to line marking devices having adjustable means for installation of parking lines and traffic markings of varying width.

Line marking devices in the prior art utilize a paint spray mechanism generally including a paint tank and a pressurized air tank interconnected by suitable coupling means. Feeder lines connected to the paint tank and a spray nozzle permit the delivery of a pressurized air and paint mixture to the surface of the road or pavement. U.S. Pat. No. 1,709,091 to Nissly discloses such road marking apparatus. Therein a paint receptacle tank and compressed fluid receptacle tank are interconnected by means of pipe and valve assemblies to permit ejection of a paint spray through a nozzle head. The nozzle head is formed in a prescribed width and length corresponding to the desired width of surface marking, the width of paint imparted to the road surface being limited by the walls of the substantially rectangular (in plan) nozzle head.

Adjustable means to limit a guide line or stripe to varying widths is achieved in the surface marking devices of the prior art by use of various paint spray baffling means disposed adjacent to the surface of the road or pavement to be marked. In U.S. Pat. No. 1,998,502 to Glasgow, such paint spray baffling means is embodied in a pair of rotatable discs held in spaced apart relationship to each side of the spray nozzle. The discs rotate over the surface of the road and are provided with screw adjustment means that permit the distance between them to be axially adjusted along the support hub. The paint spray mechanism delivers a spray of paint, the spread of paint and thus the width of the resulting guide line or stripe being limited by the spaced apart relationship of the discs. U.S. Pat. No. 1,999,563 to Glasgow discloses substantially similar means for limiting the width of the painted guide line or stripe. Rotatable discs held in spaced apart relationship to each side of the spray nozzle are threadedly attached to sleeve assemblies mounted on the support hub. By means of their threaded support, the discs may be spaced apart at various distances.

U.S. Pat. No. 2,251,719 to Sapp likewise discloses laterally adjustable discs which rotate along the road surface defining the width of the guide line or stripe to be marked. In U.S. Pat. No. 2,812,211 to Gardner a unitary spray tank is utilized providing a paint receptacle tank capable of having air pressure developed therein by means of a manual pump mechanism. Developed air pressure forces the paint from the spray tank through an attached nozzle to deliver a spray of paint onto the surface to be marked. A rectangular box shield embraces the spray nozzle, the side portions of the shield retaining the spray laterally to define the width of paint transmitted to the surface. U.S. Pat. No. 2,964,245 to Anderson et al. describes a stripe painting apparatus for use in connection with the conventional paint supply and compressed air assembly. The invention therein disclosed includes vertically extending paint shield plates which limit the lateral spray of paint from the nozzle to provide for a painted stripe of predetermined width. The paint shield plates are slidably mounted to a transverse shaft and attached to lateral-adjustment control means comprising a cable and pulley assembly which permits the distance between shield plates to be adjusted to varied spaced apart relationships. A further cable and pulley assembly is also disclosed which permits the nozzle to be adjusted to predetermined vertical positions. U.S. Pat. No. 3,050,260 to Macrae et al. discloses a paint spray carrier for use with the conventional paint supply and compressed air supply spray paint assembly. The carrier includes paint guides laterally spaced to each side of the spray nozzle comprising vertically extending rectangular plates which engage the surface to be marked at the plate's lower edge. Adjustment means is provided to position the nozzle at a distance above the surface proportionate to the spacing of the paint guides so that the spray of paint ejected from the nozzle will be appropriately confined within the paint guides.

The various paint spray baffling means as disclosed in the prior art are required as a result of the manner in which conventional paint spray mechanisms operate. Paint spray mechanisms which utilize in combination a pressurized air supply and paint supply deliver a dispersed mixture of air and paint to the surface to be marked. Baffling means serve to concentrate the paint spray. The volume of air in the delivered spray also reduces the amount of paint marking the surface, necessitating a greater volume of spray to be delivered for a desired cover than would be required to paint the same area in the absence of air in the spray. Such paint spray mechanisms thus require the operator to move along the surface to be marked at a slower pace to achieve the desired paint marking of the surface. A paint spray comprising air and paint is also more susceptible to environmental conditions, e.g. wind. Therefore, the provision of a surface marking device to mark a guide line or stripe upon the surface of a road or pavement which facilitates efficient use of paint is desirable. Also, a paint spray mechanism which permits a more quickly-paced marking of guide lines or stripes upon the surface of a road or pavement provides additional utility not presently realized by the paint spray apparatus of the prior art. It is also desirable to provide a paint spray mechanism to mark guide lines or stripes upon the surface of a road or pavement that is less sensitive to environmental conditions.

SUMMARY OF THE INVENTION

It is an object of the present invention to provide a surface marking device which utilizes an airless paint spray mechanism to mark a guide line or stripe on the surface of a road or pavement, such as for installation of parking lines and traffic markings.

Another object of the present invention is the provision of a surface marking device which eliminates the need for baffling means to limit the width of the guide line or stripe.

A further object of this invention is to provide a surface marking device which facilitates the efficient use of paint or other coloring fluid.

It is also an object of the present invention to provide a surface marking device that permits a more quickly-paced installation of parking lines and traffic markings.

A still further object of this invention is to provide a surface marking device which is less sensitive to wind and other environmental conditions.

Also, it is an object of the present invention to provide a line marking device which permits the marking of straight and curved lines.

Another object of this invention to provide a line marking device that can be easily adjusted to permit the marking of lines of varying width.

A still further object of the present invention is to provide a line marking device of simple and rugged construction.

These and other objects and advantages of the present invention will be apparent to those skilled in the art from the following drawings, description of a preferred embodiment and claims.

PREFERRED EMBODIMENT OF THE INVENTION

Figure 1:
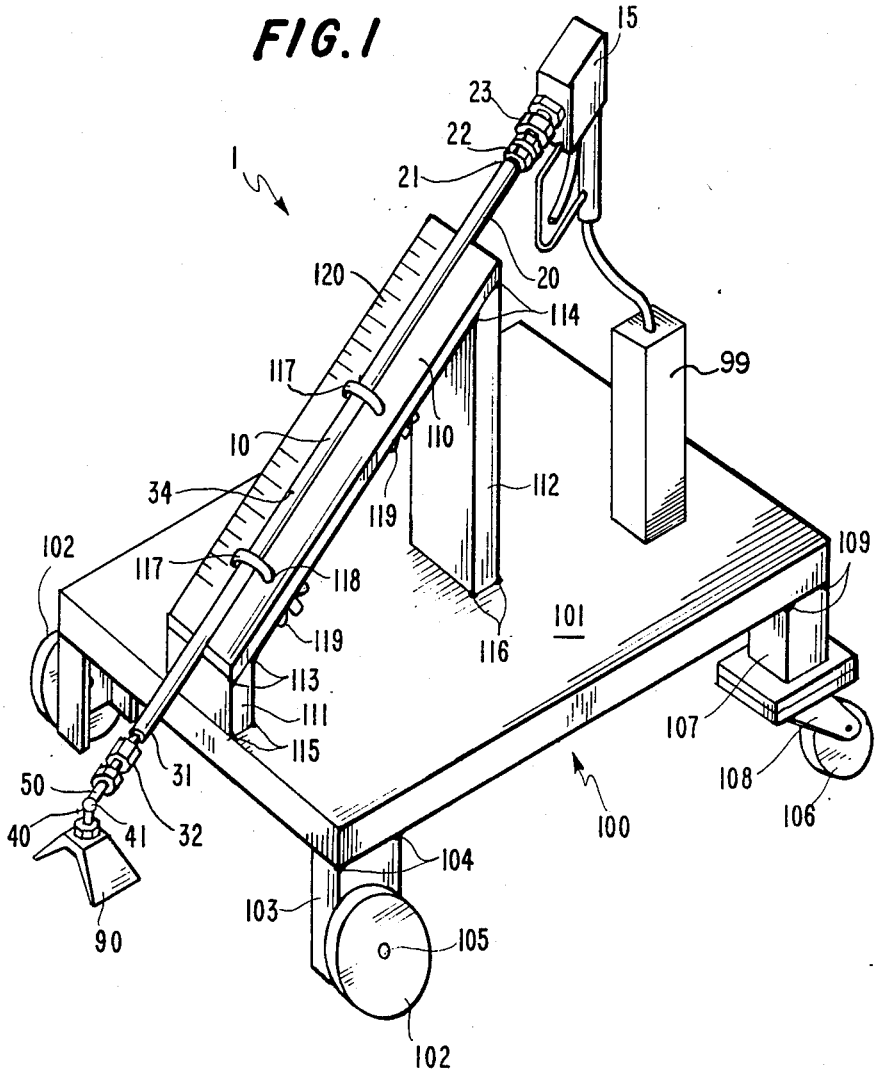
FIG. 1 is a perspective view of the line marking device of the present invention.

FIG. 1 illustrates a perspective view of the line marking device of the present invention which is generally indicated by the numeral 1. Line marking device 1 comprises a paint spray mechanism 10 and wheeled, paint spray mechanism support carrier 100. Paint spray mechanism 10 generally includes spray gun 15, hollow extension pole 20, nozzle angle head assembly 40 and spray nozzle 90. Paint spray mechanism 10 is adjustably attachable to the inclined upper table 110 of support carrier 100, extension pole 20 being held in bearing relationship with the top surface of carrier upper table 110 with attached spray gun 15 extending upwardly to the rear of support carrier 100 and spray nozzle 90 extending downwardly to the front of support carrier 100 toward the surface to be marked.

The paint spray mechanism 10 of the present invention is intended for use with airless type paint spray power systems (not shown). Since airless paint spray power systems are generally known in the prior art, no detailed description thereof is provided herein. Likewise, spray gun 15 may be any of the various types of airless spray guns known to exist in the present-day marketplace, for example, as manufactured by ASM Company, Airlessco, Glidden, Rubberset, Wagner, Graco, and Binks, and therefore no detailed description of spray gun 15 is provided.

Figure 2:
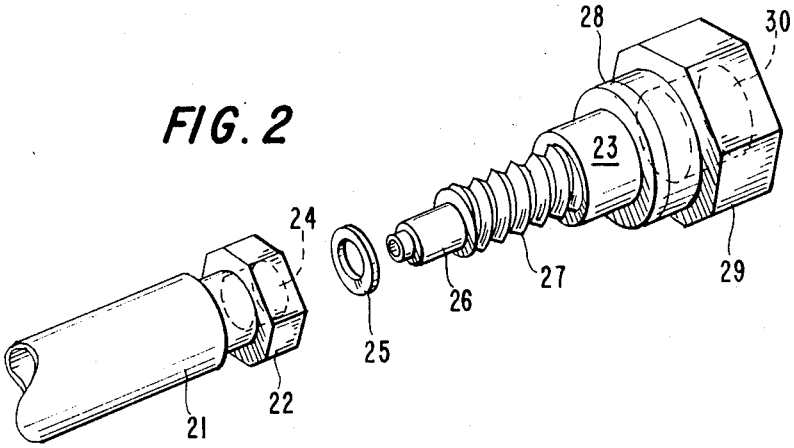
FIG. 2 is an exploded perspective view of the upwardly disposed end of the extension pole of the present invention.

Extension pole 20 generally comprises a tubular body member having a pole datum line 34 marked on its upwardly disposed outer surface. The upwardly disposed end of pole 20 having spray gun 15 attached thereto includes an integrally constructed upper end portion 21 having opposed flat surface portions 22 comprising torque-receiving means. Said torque-receiving means 22 is cooperable for engagement with a torque-applying tool means, such as a wrench or the like, to facilitate sealed engagement of the upper end portion 21 and gun adapter 23. An axial aperture 24 (FIG. 2) is formed in upper end portion 21, said aperture 24 being threaded for threadedly sealingly engagement and cooperation with gun adapter 23. As can be seen in the exploded perspective view of the upwardly disposed end of pole 20 shown in FIG. 2, gun adapter gasket means 25 is provided for circumferential disposition about the exposed end of gun adapter tip 26 to facilitate the sealed engagement of upper end portion 21 and gun adapter 23. Gun adapter 23 includes integrally constructed pole engagement portion 27 adjacent to gun adapter tip 26, the outer surface of engagement portion 27 being threaded complimentarily with the threaded aperture 24 of pole upper end portion 21 for engagement thereto. Gun adapter 23 also includes an integrally constructed spray gun receptacle 28 above pole engagement portion 27, said spray gun receptacle 28 having opposed flat surface portions 29 comprising torque-receiving means as similarly provided in pole upper end portion 21. Spray gun receptacle 28 includes an axially disposed, threaded aperture 30 formed therein for threaded engagement and cooperation with airless spray gun 15.

Again referring to FIG. 1, it can be seen that the downwardly disposed end of pole 20 includes an integrally constructed lower end portion 31 having opposed flat surface portions 32 comprising torque-receiving means. Torque-receiving means 32 of lower end portion 31 is cooperable for engagement with a torque-applying tool means to facilitate sealed engagement of the lower end portion 31 and nozzle angle head assembly 40. An axial aperture 33 (FIG. 3) is formed in pole lower end portion 31, said aperture 33 being threaded for threadedly sealingly engagement and cooperation with nozzle angle head assembly 40. Spray nozzle 90 is attachable to the downwardly disposed end of pole 20 by means of nozzle angle head assembly 40.

Figure 3:
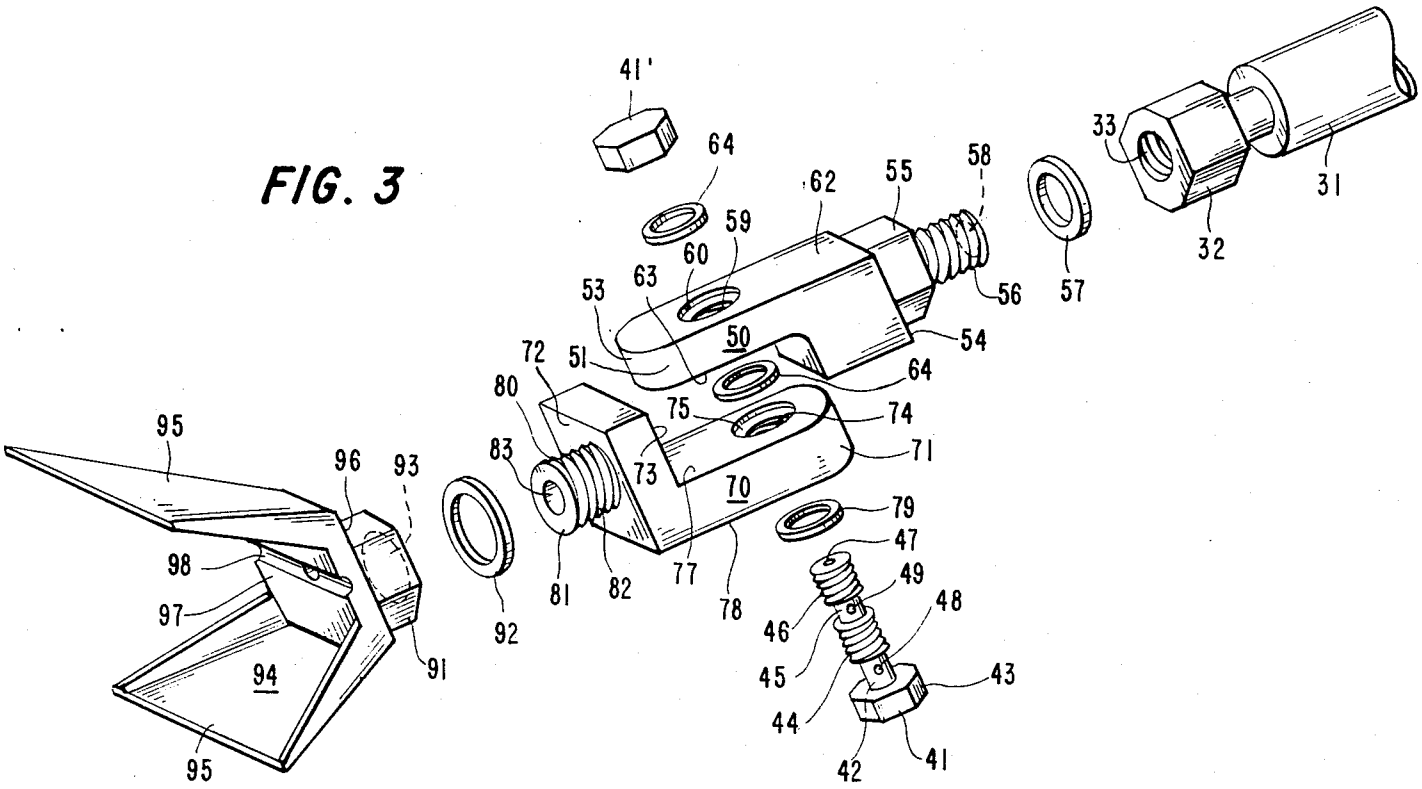
FIG. 3 is an exploded perspective view of the nozzle angle head assembly of the present invention.

FIG. 3 illustrates in an exploded perspective view the details of nozzle angle head assembly 40 and its respective connection means for attachment to pole 20 and spray nozzle 90. Nozzle angle head assembly 40 permits angularly adjustable disposition of spray nozzle 90 relative to pole 20. Nozzle angle head assembly 40 includes pole angle head 50 and nozzle adapter angle head 70 rotatably attachable to each other by means of angle head bolt 41. Pole angle head 50 is a substantially rectangular polyhedron-shaped member having a channel formed within its body (not for the flow of paint therethrough. An integrally constructed, forwardly extending pole angle head extension 51 defines the top half portion of pole angle head 50. Pole angle head extension 51 includes a substantially flat bottom wall 63 and substantially arcuated front wall 53 to facilitate rotatable cooperation with nozzle adapter angle head 70. Pole angle head rear wall 54 includes integrally constructed torque-receiving means 55 as heretofore described and pole adapter means 56. Pole adapter means 56 extends rearwardly from rear wall 54 having its outer surface threaded complimentarily with the threads of pole lower end portion aperture 33, thereby permitting threaded sealing engagement and cooperation with pole 20. Pole-angle head gasket 57 is provided for circumferential disposition abut the upper end of pole adapter means 56 to facilitate the sealed engagement of pole adapter means 56 and pole lower end portion 31. An axial pole adapter opening 58 is formed in pole adapter means 56, extending through the body of said torque-receiving means 55 to communicate with a paint channel (not shown) within the body of pole angle head 50. Pole angle head extension 51 includes a transverse threaded opening 59 formed therein to facilitate attachment of pole angle head 50 and nozzle adapter angle head 70. Threaded opening 59 includes annular recess 60 adjacent the top wall 62 and bottom wall 63 of pole angle head extension 51 for receipt of pole angle head sealing means 64, for example, "O" rings, to facilitate sealingly engagement of angle head bolt 41 and pole angle head 50 as hereinafter described. One or a plurality of paint ports (not shown) is formed in the wall of threaded opening 59 which communicates with the paint channel formed within the body of pole angle head 50.

Nozzle adapter angle head 70 is a substantially rectangular polyhedron-shaped member similar to pole angle head 50. As described for pole angle head 50, a channel (not shown) is formed within the body of nozzle adapter angle head 70 for the flow of paint therethrough. An integrally constructed, rearwardly extending nozzle adapter angle head extension 71 defines the bottom half portion of nozzle adapter angle head 70. The top wall surface 77 of said nozzle adapter angle head extension 71 is substantially flat for rotatable cooperation with pole angle head 50. Front wall 73 of nozzle adapter angle head extension 71 is substantially arcuated to facilitate angular adjustment of nozzle angle head assembly 40. Nozzle adapter angle head extension 71 includes a transverse threaded opening 74 formed therein to facilitate attachment of nozzle adapter angle head 70 and pole angle head 50. Threaded opening 74 includes annular recess 75 adjacent the top wall surface 77 and bottom wall 78 of nozzle adapter angle head extension 71 for receipt of nozzle adapter angle head sealing means 79, for example, "O" rings, to facilitate sealingly engagement of angle head bolt 41 and nozzle adapter angle head 70 as hereinafter described. One or a plurality of paint ports (not shown) is formed in the wall of threaded opening 74 which communicates with the paint channel formed within the body of nozzle adapter angle head 70. An integrally constructed nozzle adapter means 80 extends forwardly from front wall 72 of nozzle adapter angle head 70, said nozzle adapter means 80 having threads 82 formed in its outer surface for threadedly attachment with spray nozzle 90. An axially extending opening 83 is formed in nozzle adapter means 80 which communicates with the paint channel formed within the body of nozzle adapter angle head 70.

As previously noted, pole angle head 50 and nozzle adapter angle head 70 are interconnected in angularly rotatable relationship by means of angle head bolt 41. Bolt 41 is formed having a circumferentially extending lower recess 42 adjacent bolt head 43, a lower threaded portion 44 adjacent said lower recess 42, circumferentially extending upper recess 45 adjacent said lower threaded portion 44 and upper threaded portion 46 adjacent said upper recess 45. Sealing means 64,79, for example, Teflon "O" rings are provided to fit within the annular recess 60 of pole angle head extension opening 59 and annular recess 75 of nozzle adapter angle head extension opening 74, respectively, and circumferentially about the lower threaded portion 44 and upper threaded portion 46 of bolt 41. Angle head bolt 41 has an axially extending bolt channel 47 formed therein which communicates with transverse ports 48,49 respectively formed in the circumferentially extending lower bolt recess 42 and upper bolt recess 45. Lower transverse port 48 communicates with the paint ports formed in threaded opening 74 in nozzle adapter angle head extension 71. Upper transverse port 49 communicates with the paint port formed in threaded opening 59 in pole angle head extension 51. By means of channel 47 paint is permitted to flow from pole angle head 50 to nozzle adapter angle head 70.

Angle head bolt 41 extends through the threaded opening 74 in nozzle adapter angle head extension 71 having bolt head 43 positioned adjacent to the bottom wall 78 of nozzle adapter angle head extension 71. The upper section of bolt lower threaded portion 44 threadedly attaches to the lower portion of threaded opening 59 in pole angle head extension 51; the lower section of bolt lower threaded portion 44 threadedly attaches to the upper portion of threaded opening 74 in nozzle adapter angle head extension 71. In a like manner the lower section of bolt upper threaded portion 46 threadedly attaches to the upper portion of threaded opening 59 in pole angle head extension 51. The upper section of bolt upper threaded portion 46 extends beyond the pole angle head extension top wall 62 for threadedly engagement with bolt lock nut 41'. With pole angle head 50 and nozzle adapter angle head 70 interconnected as heretofore described, transverse bolt ports 49,48 are held in communication with the paint ports formed in threaded opening 59 in pole angle head extension 51 and threaded opening 74 in nozzle adapter angle head extension 71, respectively.

Paint spray nozzle 90 is an integrally constructed member including at its upper end nozzle torque-receiving means 91, formed as heretofore described, said torque-receiving means 91 having its inner wall 93 threaded complimentarily with threads 82 of nozzle adapter means 80, and at its lower end nozzle tip 94 which includes a pair of outwardly disposed nozzle blades 95 which serve as guard and guide means for the ejected paint spray. Nozzle torque-receiving means 91 is joined to nozzle tip 94 by means of integrally constructed tip support base 96 formed thereinbetween. Nozzle gasket sealing means 92 is provided to facilitate sealingly attachment of spray nozzle 90 and nozzle adapter angle head 70. The interior walls of nozzle blades 95 extend to tip support base bottom wall 97, said tip support base bottom wall 97 having a concavely recessed channel 98 formed between said nozzle blades 95 including a nozzle paint spray ejection port formed in said bottom wall channel 98. The outwardly-extending nozzle blades 95 permit the delivery of a trapezoidal paint spray upon the surface to provide a guide line or stripe of consistent width when nozzle tip 94 is positioned with tip support base bottom wall 97 in substantially parallel alignment with the surface to be marked.

Figure 4:
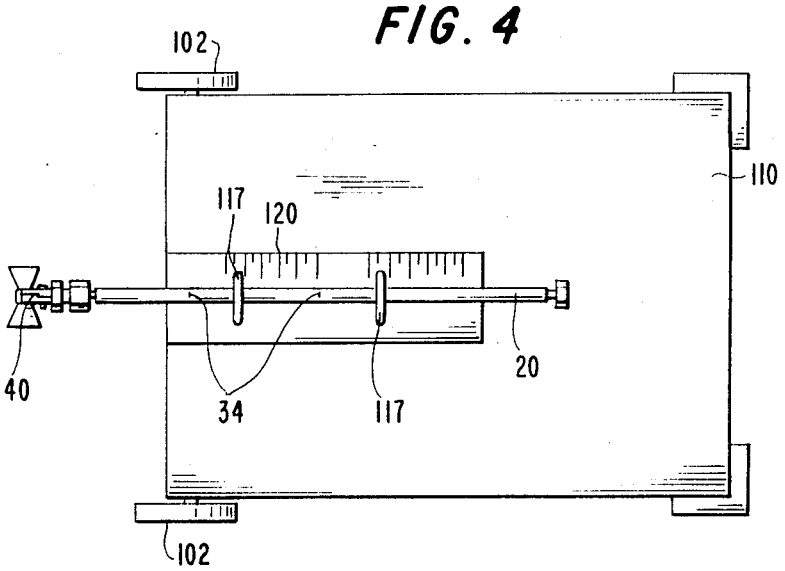
FIG. 4 is a top plan view of the line marking device of the present invention.

Referring back to FIG. 1, it can be seen that paint spray mechanism support carrier 100 includes a substantially flat, rectangular lower table 101. A paint spray power system 99 may be placed on lower table 101 during operation. Lower table 101 is supported at its front edge by offset wheels 102. Wheel support frames 103 extend vertically on each side of lower table 101 from the bottom surface of table 101 in vertical alignment with the side walls of table 101, said frames 103 being attached by weld means 104. Wheels 102 are rotatably attached to support frames 103 by means of wheel bolts 105. On each side of lower table 101 at the rear edge, support casters 106 are disposed for rear edge support of support carrier 100. Caster frames 107 extend vertically from the bottom surface of lower table 101 to caster housing 108, said caster frames 107 being attached to lower table 101 by caster frame weld means 109. Casters 106 are rotatably attached to caster housing 108, said caster housing 108 being attached to caster frame 107 in a manner to permit swivel rotation of casters 106. Inclined carrier upper table 110 is supported along the longitudinal axis of carrier lower table 101 by means of front upper table support frame 111 and rear upper table support frame 112, said support frames 111, 112 being attached to the bottom surface of carrier upper table 110 by weld means 113, 114, and to the top surface of carrier lower table 101 by weld means 115, 116. Carrier upper table 110 is downwardly inclined from rear to front, said front support frame 111 being formed at a suitably shorter length than rear support frame 112 to achieve the desired inclination. In the preferred embodiment upper table 110 is a substantially flat, rectangular member having a narrower width than carrier lower table 101. Upper table 110 extends from the front edge of front support frame 111 to the rear edge of rear support frame 112. Extension pole 20 is held in bearing support upon the top surface of upper table 110 by means of "J" bolts 117 which extend through bolt holes 118 formed in upper table 110 to one side of the area disposed for receipt of pole 20. "J" bolts 117 are threaded at their lower end and are secured by means of wing nuts 119 which are threaded complimentarily with the threads of "J" bolts 117 for threaded engagement and cooperation therewith. As can be seen in the top plan view of line marking device 1 shown in FIG. 4, support carrier 100 includes a suitably graduated scale 120 on the top surface of carrier upper table 110. The width of guide line or stripe to be marked upon the surface of the road or pavement can be varied by aligning pole datum line 34 with the desired corresponding marking on scale 120.

Figure 5:
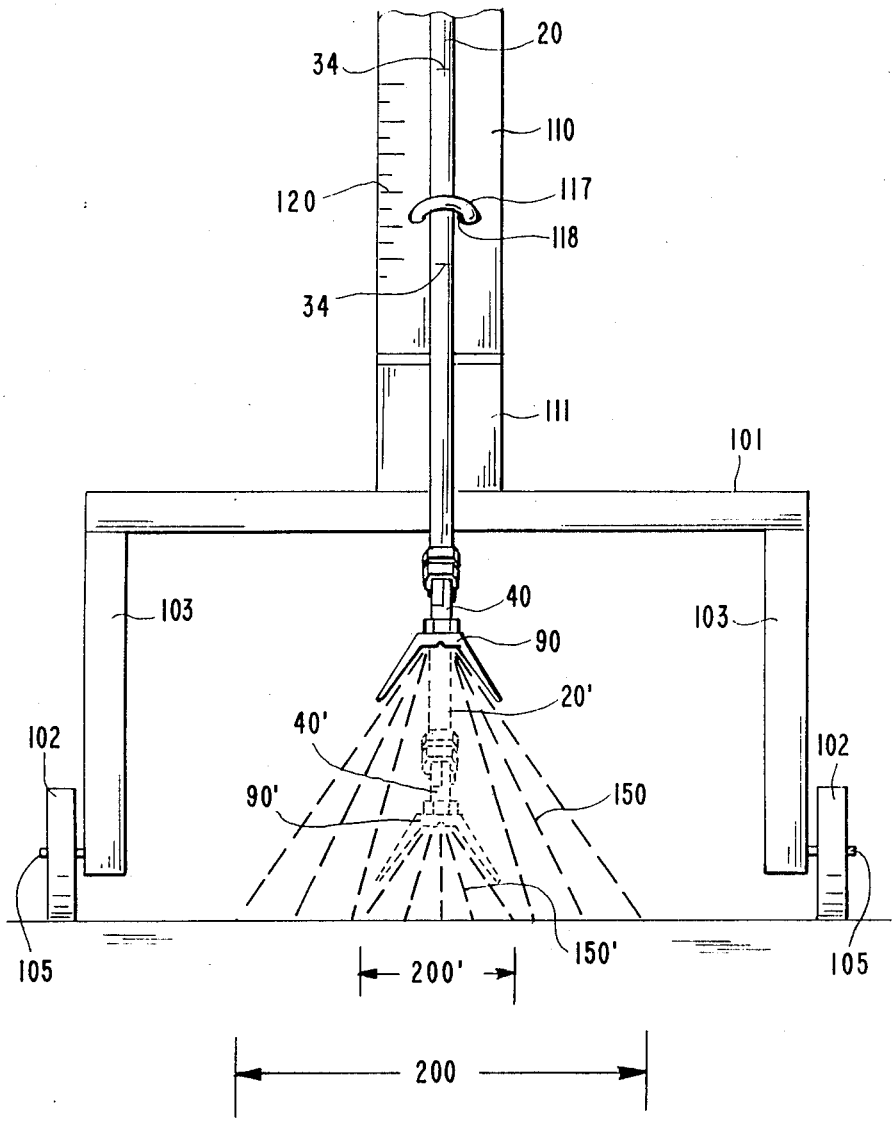
FIG. 5 is a front elevational view of the line marking device of the present invention, illustrating operation of the adjustment means to achieve lines of varying width.

Paint spray mechanism 10 may be adjusted to position spray nozzle 90 at various heights above the surface of the road or pavement to be marked by placing extension pole 20 at various positions in bearing relation to the upper table 110. As datum line 34 is moved down scale 120 toward the front of line marking device 1, the width of the guide line or stripe is progressively decreased. FIG. 5 is a front elevational view of the line marking device 1 of the present invention illustrating adjustment of paint spray mechanism 10 to mark guide lines of varying widths. A first position of paint spray mechanism 10 is indicated by the full lines; a second position corresponding to a lowering of paint spray mechanism 10 is indicated by the dotted lines. Paint spray mechanism 10 delivers a trapezoidal spray 150 from spray nozzle 90, the width of guide line or stripe 200 delivered to the surface of the road or pavement being defined by the vertical distance of nozzle 90 from the surface to be marked. With paint spray mechanism 10 in the first position to paint for example, a 6" guide line or stripe 200,pole datum line 34 is aligned with the corresponding marking on scale 120 for a 6" guide line, thereby positioning spray nozzle 90 above the surface to deliver paint spray 150. For a 3" guide line or stripe 200', for example, paint spray mechanism 10' is lowered to second position along scale 120 for 3" guide line. Spray nozzle 90' is thereby lowered to the required vertical distance from the surface to deliver paint spray 150' which corresponds to the marking of a 3" guide line or stripe 200'.

For operation of the line marking device 1 of the present invention, paint spray mechanism 10 should be assembled as heretofore described, utilizing torque-applying tool means as appropriate to assure sealingly engagement and cooperation. Paint spray mechanism 10 is then connected to paint spray power system. The power system may be placed on the top surface of carrier lower table 101 for support thereof. Extension pole 20 is then placed on the upper table 110 of support carrier 100 with the attached spray gun 15 upwardly disposed to the rear of support carrier 100, and attached nozzle angle head assembly 40 and nozzle 90 downwardly disposed to the front of support carrier 100. To position paint spray mechanism 10 to mark on the surface a guide line or stripe of a particular width, for example, a 3" guide line or stripe, pole datum line 34 is aligned with the marking on scale 119 corresponding to a 3" guide line. "J" bolts 117 are then utilized to secure pole 20 in place by extending "J" bolts 117 through bolt holes 118 and tightening wing nuts 119 about the threaded end of "J" bolts 117. Paint spray power system is then engaged and line marking device 1 is manuvered across the surface to be marked by the operator pushing device 1 while maintaining gripping control of spray gun 15.

To change the width of guide line or stripe 200, "J" bolts 117 are loosened sufficiently to allow paint spray mechanism 10 to be slidably moved along carrier upper table 110. Pole datum line 34 is again aligned with the marking on scale 120 corresponding to the desired guide line width to be marked on the surface. "J" bolts 117 are then tightened about pole 20 by turning wing nuts 119 about the threaded end of "J" bolts 117. Operation proceeds by the operator pushing device 1 while maintaining gripping control of spray gun 15.

It is to be noted that the provision of swivelling casters at the rear of the carrier support permits the line marking device of the present invention to be utilized to paint straight or curved lines upon the surface of a road or pavement.

Various changes may be made in the details of construction as heretofore described without departing from the spirit of the invention and the scope of the appending claims.

What is claimed is:

1. A surface marking device adapted to mark a guide line or stripe upon the surface of a road or pavement for installation of parking lines and traffic markings, comprising in combination, airless paint spray power system, airless paint spray mechanism and wheel-mounted paint spray mechanism support carrier; said airless paint spray mechanism, including airless paint spray gun, hollow extension pole, nozzle angle head assembly, and paint spray nozzle wherein said airless paint spray gun is attachable to said airless paint spray power system by suitable first connection means and to one end of said extension pole by suitable second connection means; wherein said nozzle angle head assembly is attachable to the opposite end of said extension pole by suitable third connection means and to said paint spray nozzle by suitable forth connection means; said paint spray mechanism being supported above the surface of said road or pavement by said support carrier in a manner having said airless paint spray gun upwardly disposed to the rear of said support carrier and said paint spray nozzle downwardly disposed to the front of said support carrier towards the surface of the road or pavement to be marked; said hollow extension pole generally comprising a tubular body member having a datum line to cooperate with a scale, said datum line being marked upon an upwardly disposed outer surface of said tubular member and including integrally constructed upper end portion and lower end portion, said upper end portion having opposed flat surface portions comprising torque-receiving means, said torque-receiving means being cooperable for engagement with torque-applying tool means to facilitate engagement of said upper end portion and a gun adapter, said upper end portion including an axial aperture formed therein, said aperture being threaded for threadedly engagement and cooperation with said gun adapter; said lower end portion having opposed flat surface portions comprising torque-receiving means, said torque-receiving means being cooperable for engagement with torque-apply tool means to facilitate engagement of said lower end portion and said nozzle angle head assembly, said lower end portion including an axial aperture formed therein, said aperture being threaded for threadedly engagement and cooperation with said nozzle angle head assembly and wherein said nozzle angle head assembly permits angularly adjustable disposition of said spray nozzle relative to said extension pole; said surface marking device further including a pole-angle head gasket, wherein said nozzle angle head assembly includes a pole angle head gasket wherein said nozzle angle head assembly includes pole angle head and nozzle adapter angle head, said pole angle head and nozzle adapter angle head being rotably attachably to each other by means of an angle head bolt; said pole angle head comprising a substantially rectangular polyhedron-shaped member having a channel formed within its body for flow of paint therethrough and an integrally constructed, forwardly extending pole angle head extension defining the top half portion of pole angle head, said pole angle head extension having a substantially flat bottom wall and a substantially arcuated front wall to facilitate rotatable cooperation with said nozzle adapter angle head, said pole angle head having a rear wall including integrally constructed torque-receiving means and pole adapter means which extend rearwardly from said rear wall, said pole adapter means having its outer surface threaded complimentarily with the threads of pole lower end portion aperture thereby permitting threadedly engagement and cooperation with said extension pole, said pole angle head gasket being provided for circumferential disposition about the upper end of pole adapter means to facilitate sealed engagement of pole adapter means and pole lower end portion, said pole adapter means having an axial opening formed therein extended through the body of said torque-receiving means which communicates with said paint channel formed within the body of pole angle head, said pole angle head extension including a transverse threaded opening formed therein to facilitate attachment of said pole angle head and said nozzle adapter head, said threaded opening including an annular recess adjacent the top wall and bottom wall of said pole angle head extension, said recess being provided for receipt of pole angle head sealing means to facilitate sealingly engagement of angle head bolt, said threaded opening including at least one port which communicates with said pole angle head channel; said nozzle adapter angle head comprising a substantially rectangular polyhedron-shaped member having a channel formed within its body for flow of paint therethrough and an integrally constructed, rearwardly extending nozzle adapter angle head extension defining the bottom half portion of said nozzle adapter angle head, said nozzle adapter angle head extension having a substantially flat top wall and a substantially arcuate rear wall to facilitate rotatable cooperation with said pole angle head, said nozzle adapter angle head extension including a transverse threaded opening formed therein to facilitate attachment of nozzle adapter angle head and pole angle head, said threaded opening including an annular recess adjacent the top wall and bottom wall of nozzle adapter angle head extension for receipt of nozzle adapter angle head sealing means to facilitate sealingly engagement of angle head bolt, said threaded opening including one or a plurality of ports which communicate with said nozzle adapter angle head channel, said nozzle adapter angle head having a front wall including integrally constructed nozzle adapter means extends forwardly from said front wall having its outer surface threaded for threadedly attachment with said spray nozzle, said nozzle adapter means having an axially extending opening formed therein which communicates with said paint channel formed within the body of said nozzle adapter angle head; said angle head bolt being formed having circumferentially extending lower recess adjacent bolt head, lower threaded portion adjacent said lower recess, circumferentially extending upper recess adjacent said lower threaded portion, and upper threaded portion adjacent said upper recess, said angle head bolt having an axially extending bolt channel whereby paint is permitted to flow from pole angle head to said nozzle adapter angle head by means of transverse ports formed in said upper bolt recess and said lower bolt recess, said upper bolt port being in communication with ports formed in the threaded opening in pole angle head extension, said lower bolt port being in communication with ports formed in the threaded opening in said nozzle adapter angle head extension.

2. A surface marking device as described in claim 1, including nozzle gasket sealing means provided to facilitate sealingly attachment of said paint spray nozzle and said nozzle adapter angle head, wherein said paint spray nozzle is an integrally constructed member including at its upper end nozzle torque-receiving means and at its lower end a nozzle tip, said nozzle torque-receiving means and nozzle tip being joined by means of integrally constructed tip support base formed thereinbetween, said nozzle torque-receiving means having its inner wall threaded complimentarily with threads of nozzle adapter means, said nozzle tip comprising a pair of outwardly disposed nozzle blades having interior walls which extend to tip support base bottom wall, said tip support base bottom wall having a concavely recessed channel formed between said nozzle blades including a spray nozzle paint ejection port formed in said bottom wall channel, said nozzle blades permitting delivery of a trapezoidal paint spray upon the surface to provide a guide line or stripe of consistent width when nozzle tip is positioned with tip support base bottom wall in substantially parallel alignment with the surface to be marked.

3. A surface marking device adapted to mark a guide line or stripe upon the surface of a road or pavement for installation of parking lines and traffic markings, comprising in combination, airless paint spray power system, airless paint spray mechanism, and wheel-mounted paint spray mechanism support carrier; said airless paint spray mechanism including airless paint spray gun, hollow extension pole, nozzle angle head assembly, and paint spray nozzle, wherein said airless paint spray gun is attachable to said airless paint spray power system by suitable first connection means and to one end of said extension pole by suitable second connection means; wherein said nozzle angle head assembly is attachable to the opposite end of said extension pole by suitable third connection means and to said paint spray nozzle by suitable fourth connection means; said paint spray mechanism being supported above the surface of said road or pavement by said support carrier in a manner having said airless paint spray gun upwardly disposed to the rear of said support carrier and said paint spray nozzle downwardly disposed to the front of said support carrier toward the surface of the road or pavement to be marked, wherein said paint spray mechanism support carrier generally comprises a substantially flat support carrier lower table, and a support carrier upper table downwardly inclined from rear to front; said lower table being supported at its front edge by offset wheels, each wheel being rotatably attached to wheel support frame by means of wheel bolt, said wheel support frames extending vertically on each side of said lower table from the bottom wall surface of said lower table in vertical alignment with the side walls of said lower table, being attached thereto by weld means; said lower table being supported at its rear edge by casters, each caster being rotatably attached to a caster housing, said caster housing being attached to a caster frame in a manner to permit swivel rotation of the caster, said caster frames extending vertically on each side of the lower table from the bottom wall surface of said lower table, being attached thereto by weld means; said upper table being supported along the longitudinal axis of said carrier lower table by means of a front upper table support frame and a rear upper table support frame, said front upper table support frame being formed at a suitably shorter length than said rear upper table support frame to achieve the desired downward inclination of the carrier upper table from rear to front, said carrier upper table extending from the front edge of said front upper table support frame to the rear edge of said rear upper table support frame, said front upper support frame and said rear upper table support frame being attached to the carrier upper table by weld means at the bottom surface of said upper table, and being attached to carrier lower table by weld means at the top surface of said carrier lower table said upper table having bolt holes formed therein to one side of the area disposed for receipt of said paint spray mechanism, said paint spray mechanism being held in place by means of "J" bolts having threaded ends and which extend through said upper table bolt holes, said "J" bolts being secured by means of wing nuts, said wing nuts being threaded complimentarily with the threads of said "J" bolts for threadedly engagement and cooperation therewith; said support carrier including a suitably graduated scale on the top surface of said carrier upper table to facilitate adjustment of said paint spray mechanism to mark guide lines or stripes of varying widths.

* * * * *